United States Patent [19]

Ave et al.

[11] Patent Number: 4,844,041

[45] Date of Patent: Jul. 4, 1989

[54] METHOD OF CONTROLLING THE AIR/FUEL RATIO FOR AN INTERNAL COMBUSTION ENGINE MOUNTED ON A VEHICLE

[75] Inventors: Yoshiharu Ave; Junichi Koseki; Hiroaki Iwasaki; Norio Tomobe; Kozo Suzuki, all of Wako, Japan

[73] Assignee: Honda Giken Kogyo Kabushiki Kaisha, Tokyo, Japan

[21] Appl. No.: 163,677

[22] Filed: Mar. 3, 1988

[30] Foreign Application Priority Data

Mar. 5, 1987 [JP] Japan ..... 62-050471
Nov. 30, 1987 [JP] Japan ..... 62-303009

[51] Int. Cl.[4] ..... F02D 41/14; F02D 41/06
[52] U.S. Cl. ..... 123/489; 123/491
[58] Field of Search ..... 123/440, 489, 491, 179 L

[56] References Cited

U.S. PATENT DOCUMENTS

| | | | |
|---|---|---|---|
| 4,130,095 | 12/1978 | Bawler et al. | 123/440 |
| 4,235,204 | 11/1980 | Rice | 123/489 X |
| 4,306,529 | 12/1981 | Chiesa et al. | 123/491 X |
| 4,475,517 | 10/1984 | Kobayashi et al. | 123/489 |
| 4,715,344 | 12/1987 | Tomisawa | 123/489 |
| 4,796,589 | 1/1989 | Fujimoto et al. | 123/489 |

*Primary Examiner*—Tony M. Argenbright
*Attorney, Agent, or Firm*—Pollock, VandeSande & Priddy

[57] ABSTRACT

A method of controlling the air/fuel ratio for an internal combustion engine set a base value of air/fuel ratio control in accordance with detected engine parameters, and the base value is corrected by a base correction value in order to compensate for the error of the base value. The speed of change in the correction value in the learning control operation is increased when the engine speed is low, or for a predetermined time period after a hot starting of the engine.

5 Claims, 11 Drawing Sheets

METHOD OF CONTROLLING THE AIR/FUEL RATIO FOR AN INTERNAL COMBUSTION ENGINE MOUNTED ON A VEHICLE

BACKGROUND OF THE INVENTION

1. Field of the Invention

The present invention relates to a method of controlling the air/fuel ratio for an internal combustion engine mounted on a vehicle.

2. Description of Background Information

Feedback type air/fuel ratio control systems for an internal combustion engine are known from, for example, Japanese Patent Publication No. 55-3533, which systems perform a feedback control of the air-fuel ratio of the mixture to be supplied to the engine wherein the concentration of an exhaust gas component in the exhaust gas such as the oxygen concentration is detected by an exhaust gas component concentration sensor (for example, an oxygen concentration sensor), and the volume of air or fuel to be supplied to the engine is regulated in response to the detected value obtained by the exhaust gas component concentration sensor, in order to attain the purification of the exhaust gases, the improvement of the fuel economy, etc.

In this type of conventional air/fuel ratio control systems, a PI (Proportional and Integral) control is normally adopted in which a base value of the air/fuel ratio control indicating the amount of the intake side secondary air is determined in accordance with a plurality of operation parameters relating to the engine load, whether the air/fuel ratio of the supplied mixture is leaner or richer than a desired air/fuel ratio such as the stoichiometric air/fuel ratio is determined from the output signal level of the exhaust gas component concentration sensor, a correction value of the air/fuel ratio is increased or decreased by a proportional value or an integral value at predetermined intervals in accordance with the result of the determination, and the base value of the air/fuel ratio is corrected in accordance with the correction value of the air/fuel ratio.

On the other hand, due to a change caused by the lapse of time, or deterioration, of the carburetor, it is general that the base air/fuel ratio value of the carburetor becomes to deviate from a predetermined value so that the base value of the air/fuel ratio control will not correspond to the desired air/fuel ratio, thereby causing an error.

Therefore, there are some methods wherein a learning control is executed in which a base correction value for correcting the error of the base value of air/fuel ratio control is calculated for every operational region during the feedback control of air/fuel ratio, and the calculated base correction value is stored in a memory device such as a RAM and is renewed, to accomplish an improvement of the accuracy of the air/fuel ratio control operation.

The base correction value or an amount of change in the base correction value is normally calculated every time the air/fuel ratio of the supplied mixture turns over with respect to the desired air/fuel ratio, and the renewal of the base correction value is performed by storing the newest base correction value when the operational region changes.

On the other hand, when te engine is idling, the speed of combustion is slower than other operational states, and the speed of change in the air/fuel ratio correction value remains small because the proportional and integral control amounts are small. Therefore, the period from one turn-over of the air/fuel ratio of the supplied mixture with respect to the desired air/fuel ratio to the next turn-over becomes long, and the calculation of the base correction value is not performed frequently.

Therefore, when the engine speed is low, such as in the idling state, there has been a drawback that the renewal of the base correction value will be delayed. Especially , when the number of renewal is not sufficiently large, such as with a vehicle having a small total mileage, or in the event that characteristic of the carburetor has changed suddenly, the delay of the renewal of the base correction value will adversely affect on the feedback control of the air/fuel ratio so that the air/fuel ratio will be biased on the rich or lean side, to cause degradation of the performance of the exhaust gas purifying operation.

On the other hand, with respect to internal combustion engines mounted on a vehicle, there is a condition that the engine is once stopped after running long time at high speed for example, and subsequently the engine is started again under the condition of high temperature. Such a condition can produce the percolation phenomenon by which a large quantity of fuel is pushed out from the nozzle of the carburetor by the pumping function of bubbles of vaporized fuel which has been generated from the fuel in the float chamber of the carburetor and the fuel supply passage due to the heat during the stop of the engine. Therefore, the air/fuel ratio of the supplied mixture is enriched immediately after the hot starting of the engine, and there has been a problem that the emission of unburnt components such as CO (carbon monoxide) and HC (hydrocarbons) is increased.

Furthermore, if the temperature of the intake air is high during an idling state after the hot starting of the engine, the air/fuel ratio becomes excessively rich because of the reduction in the density of air in addition to the vapor of fuel from the carburetor, and moreover, due to the reduction in the replenishment efficiency in the combustion chamber, the air/fuel ratio becomes over-rich. Since the correction amount of air/fuel ratio by the proportional-integral control operation remains small and the speed of correction of the over-rich by the supply of the intake side secondary air is also small during the idling state, such an idling state after the hot starting of the engine as mentioned above can cause a drop of the engine rotational speed. The over-rich air/fuel ratio is continued until the vapor of fuel once adhered in the intake pipe is completely absorbed, therefore, the emission of CO and HC especially, is increased during such a period.

SUMMARY OF THE INVENTION

It is a first object of the present invention to provide a method for controlling the air/fuel ratio in which is always renewed shortly the base correction value for correcting the base air/fuel ratio control value which is dominant in determining the air/fuel ratio control amount in the air/fuel ratio control operation, thereby improving the efficiency of the exhaust gas purification operation.

A second object of the present invention is to provide an air/fuel ratio control method by which the efficiency of the exhaust gas purifying operation and the stability of the rotational speed of the engine immediately after the hot starting of the engine are improved.

According to a first aspect of the present invention, a method of controlling the air/fuel ratio for an internal combustion engine mounted on a vehicle and provided in its exhaust system with an exhaust gas component concentration sensor which produces an output signal corresponding to the concentration of an exhaust gas component in the exhaust gas, comprises steps of setting a base value of air/fuel ratio control in accordance with engine operational parameters, correcting the base value of air/fuel ratio control in accordance with a base correction value, comparing the output value of the exhaust gas component concentration sensor with a reference value of determination of the air/fuel ratio and adjusting an air/fuel ratio correction value in accordance with the result of comparison, calculating an air/fuel ratio control output value in accordance with at least one of the air/fuel ratio correction value and the corrected base value of air/fuel ratio control, controlling an air/fuel ratio of mixture supplied to the engine in accordance with the air/fuel ratio control output value, correcting the base correction value by a value corresponding to a renewal coefficient in basis of the air/fuel ratio correction value, and increasing the magnitude of the renewal coefficient as the engine rotational speed decreases.

According to a second aspect of the present invention, a method of controlling the air/fuel ratio for an internal combustion engine mounted on a vehicle and provided in its exhaust system with an exhaust gas component concentration sensor which produces an output signal corresponding to the concentration of an exhaust gas component in the exhuast gas, comprises steps of setting a base value of air/fuel ratio control in accordance with engine operational parameters, correcting the base value of air/fuel ratio control in accordance with a base correction value, comparing the output value of the exhaust gas component concentration sensor with a reference value of determination of the air/fuel ratio and adjusting an air/fuel ratio correction value in accordance with the result of comparison, calculating an air/fuel ratio control output value in accordance with at least one of the air/fuel ratio correction value and the corrected base value of the air/fuel ratio control, controlling an air/fuel ratio of mixture supplied to the engine in accordance with the air/fuel ratio output value, correcting a cumulative correction value for renewing the base correction value, by a value corresponding to a renewal coefficient on basis of the air/fuel ratio correction value, renewing the base correction value in accordance with the cumulative correction value every time an operational state of the engine changes from one operational region to another, and increasing the magnitude of the renewal coefficient as the engine rotational speed decreases.

According to a third aspect of the present invention, a method of controlling the air/fuel ratio for an internal combustion engine comprises steps of comparing an exhaust gas component concentration detection value detected by an exhaust gas component concentration sensor with a reference value, adjusting an air/fuel ratio correction value in accordance with a result of the comparison, controlling an air/fuel ratio of mixture supplied to the engine in accordance with the air/fuel ratio correction value, and increasing the speed of adjustment of the air/fuel ratio correction value for a predetermined time period after a starting operation of the engine if the temperature of the engine is higher than a predetermined temperature at the starting of the engine.

DETAILED DESCRIPTION OF THE PREFERRED EMBODIMENTS

Referring to the accompanying drawings, the embodiments of the present invention will be explained in detail hereinafter.

Figure 1:
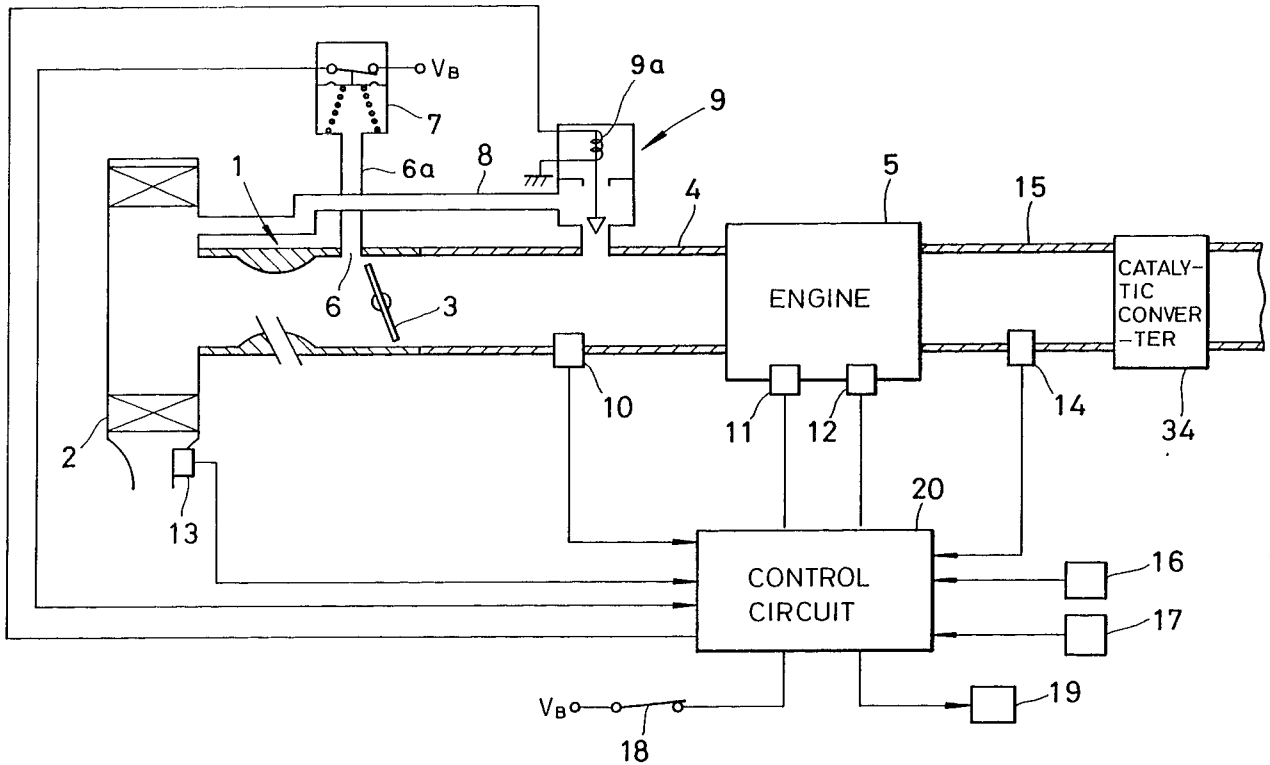
FIG. 1 is a schematic diagram showing a general construction of the air/fuel ratio control system in which the control method according to the present invention is applied.

FIG. 1 illustrates a general construction of an air/fuel ratio control system of an internal combustion engine mounted on a vehicle, in which the method for controlling the air/fuel ratio according to the present invention is applied. In this air/fuel ratio control system, an intake manifold 4 on the downstream side of a throttle valve 3 of a carburetor 1 communicates with an air cleaner 2, near an air outlet port thereof, by means of an intake side secondary air supply passage 8. The intake side secondary air supply passage 8 is provided with the so-called linear type solenoid valve 9. The opening degree of the solenoid valve 9 is varied in proportion to the value a current supplied to a solenoid 9*a* thereof.

The inner wall of the carburetor 1 near the throttle valve 3 is provided with a vacuum detection port 6. The vacuum detection port 6 is located so that it is on the upstream side of the throttle valve 3 when the throttle valve opening is smaller than a predetermined degree, and on the downstream side of the throttle valve 3 when the opening of the throttle valve 3 is larger than the predetermined degree. A vacuum Pc in the vacuum detection port 6 is supplied to a vacuum switch 7 through a vacuum passage 6*a*. The vacuum switch 7 is provided in order to detect the closure of the throttle valve 3, and turns on when the vacuum in the vacuum detection port 6 is, for example, smaller than 30 mmHg.

On the other hand, an absolute pressure sensor 10 which is provided in the intake manifold 4 produces an output signal whose level corresponds to an absolute pressure $P_{BA}$ in the intake manifold 4. A crank angle sensor 11 produces pulse signals synchronized with the revolution of a crankshaft (not shown) of an internal combustion engine 5 (referred to simply as engine hereinafter), for example, TDC pulses. A cooling water temperature sensor 12 produces an output signal whose level corresponds to the temperature $T_W$ of the cooling water of the engine 5. An intake air temperature sensor 13 produces an output voltage corresponding to the temperature $T_A$ of the intake air. An oxygen concentration sensor 14 is provided in an exhaust manifold 15 of the engine 5 as an exhaust gas component concentration sensor, and generates an output voltage corresponding to the oxygen concentration in the exhaust gas. The oxygen concentration sensor 14 is, for example, a $\lambda=1$ type sensor whose output voltage varies widely around the stoichiometric air/fuel ratio. In the exhaust manifold 15 at a location on the downstream side of the oxygen concentration sensor 14, there is provided a catalytic converter 34 for accelerating the reduction of noxious components in the exhaust gas. Output signals of the vacuum switch 7, the solenoid valve 9, the absolute pressure sensor 10, the crank angle sensor 11, cooling water temperature sensor 12, the intake air temperature sensor 13, and the oxygen concentration sensor 14, are supplied to a control circuit 20. Further, a vehicle speed sensor 16 which produces an output having a level corresponding to the speed V of the vehicle, an atmospheric pressure sensor 17 which generates an output signal in response to the atmospheric pressure $P_A$, and a clutch switch 18 which turns off when a clutch pedal (not shown) is depressed, are connected to the control circuit 20. The vacuum switch 7 and the clutch switch 18 respectively produce a low level output when turned off, and produce a high level output of a voltage $V_B$ when turned on.

Figure 2:
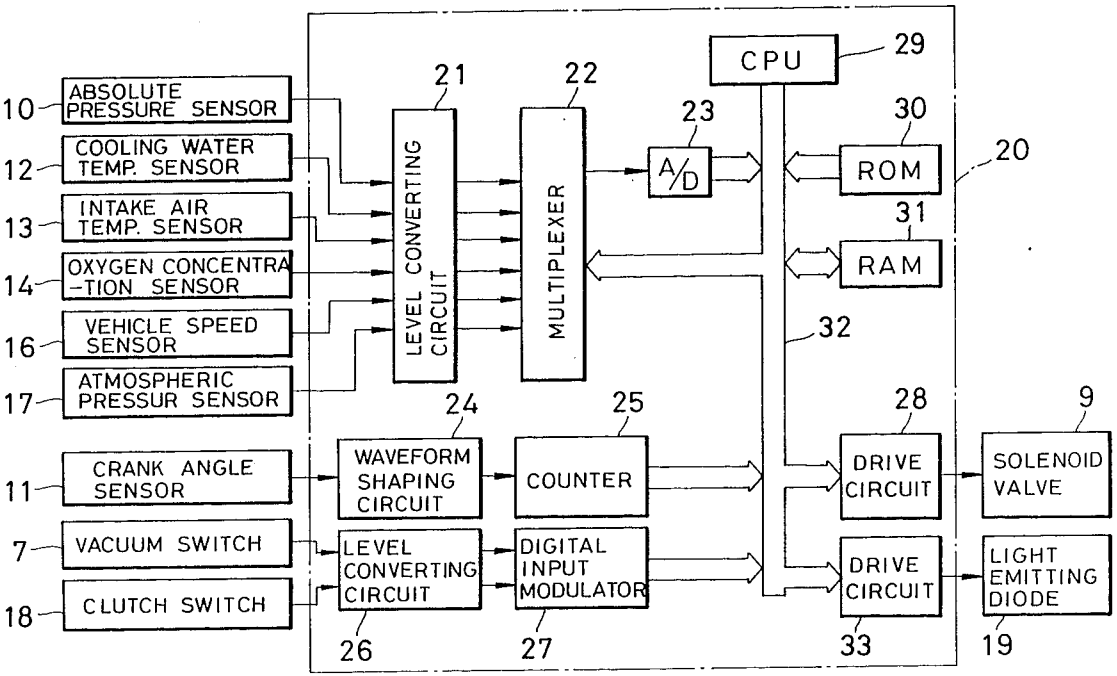
FIG. 2 is a block diagram showing the construction of the control circuit of the system of FIG. 1.

As shown in FIG. 2, the control circuit 20 includes a level converting circuit 21 which performs level conversion of the input signals of the absolute pressure sensor 10, the cooling water temperature sensor 12, the intake air temperature sensor 13, the oxygen concentration sensor 14, the vehicle speed sensor 16, and the atmospheric pressure sensor 17. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which performs a waveform shaping of the output signal of the crank angle sensor 11, a counter 25 which measures intervals of the output pulses of the waveform shaping circuit 24 by counting the number of clock pulses supplied from a clock pulse generator (not shown), to provide data of engine speed Ne. Further, the control circuit 20 includes a level converting circuit 26 for performing level conversion of output levels of the vacuum switch 7 and the clutch switch 18, a digital input modulator 27 for transforming the level converted output into digital data, a drive circuit 28 for driving the solenoid valve 9, a drive circuit 33 for lighting a light emitting diode 19 for alarm purpose, a CPU (central processing unit) 29 which performs digital operations according to programs, a ROM 30 in which various operating programs and data are previously stored, and a RAM 31.

The solenoid 9*a* of the solenoid valve 9 is connected in series with a drive transistor and a current detection resistor, both not shown, of the drive circuit 28, and a power voltage is supplied across terminals of the above mentioned series circuit. The multiplexer 22, the A/D converter 23, the counter 25, the digital input modulator 27, the drive circuit 28, the CPU 29, the ROM 30, and the RAM 31 are mutually connected via an input-/output bus 32. In addition, the CPU 20 includes timers A through E (not shown), and the RAM 31 is of the non-volatile type.

With this construction, information of the absolute pressure $P_{BA}$ in the intake manifold 4, the cooling water temperature $T_W$, the intake air temperature $T_A$, the oxygen concentration $O_2$ in the exhaust gas, the vehicle speed V, and the atmospheric pressure $P_A$, selectively from the A/D converter 23, information indicative of the engine speed Ne from the counter 25, and on/off information of the vacuum switch 7 and the clutch switch 18 from the digital input modulator 27 are supplied to the CPU 29 through an input/output bus 32.

After turn-on of an ignition switch (not shown), the CPU 29 repeatedly executes programs in accordance with a clock pulse, to calculate an air/fuel ratio control output value $AF_{OUT}$ ($AF_{OUT}'$) indicative of the magnitude of the supply current to the solenoid 9*a* of the solenoid valve 9, as will be explained later, in the form of data, and supplies the calculated output valve $AF_{OUT}$ ($AF_{OUT}'$) to the drive circuit 28. The drive circuit 28 performs a closed loop control of the magnitude of the current flowing through the solenoid 9*a* so that it is controlled to a valve indicated by the output value $AF_{OUT}$.

Referring to the flowcharts of FIGS. 3(*a*), 3(*b*), 5(*a*) 5(*b*), 6, and 7 indicating processes performed by the CPU 29, the first embodiment of the air/fuel ratio control method will be explained in detail hereinafter.

Figure 3A:
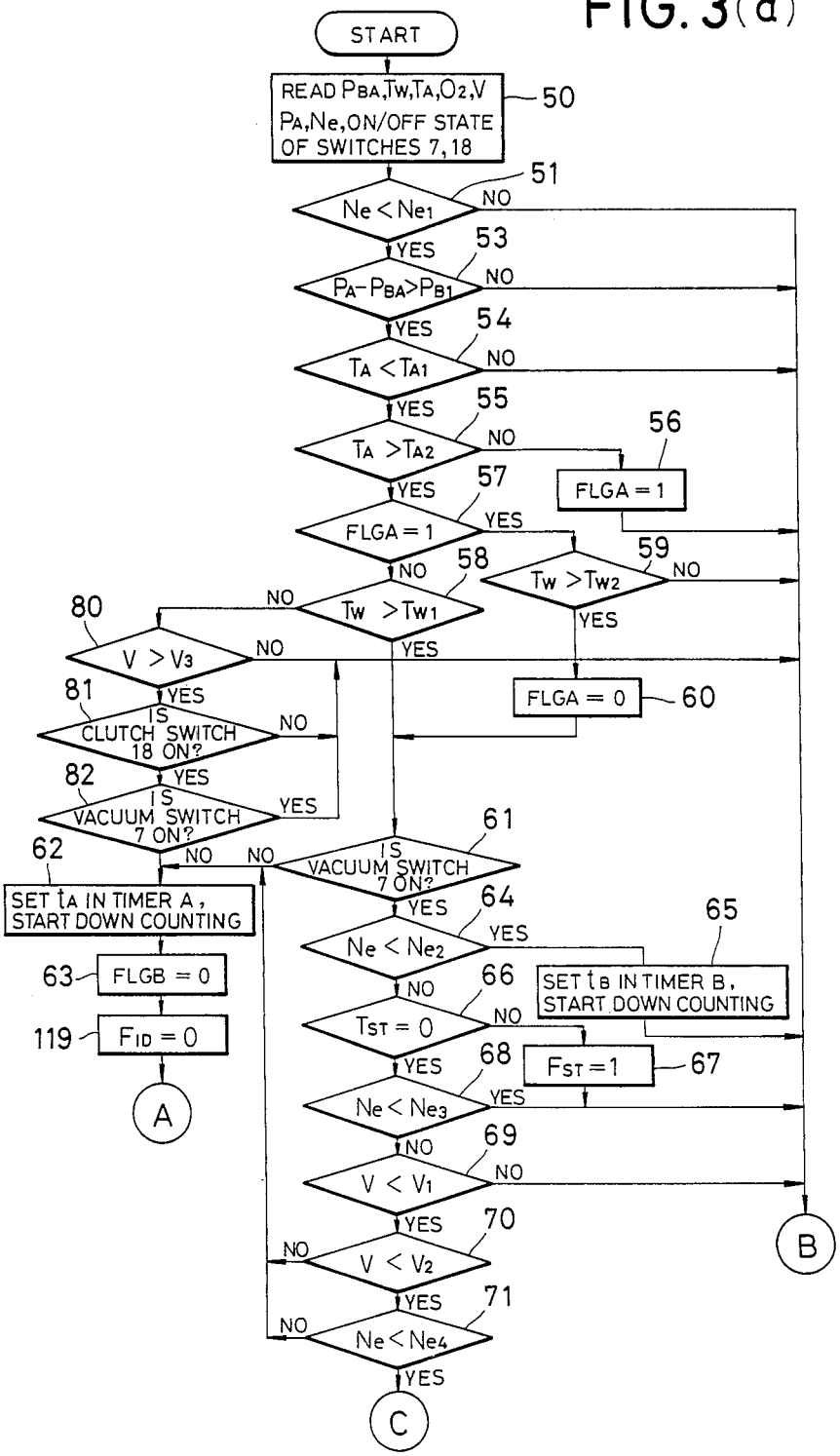
FIGS. 3(*a*), 3(*b*), 5(*a*), 5(*b*) 6, and 7 are flowcharts showing the manner of operation of a CPU in the control circuit in a first embodiment of the control method according to the present invention.
Figure 3:
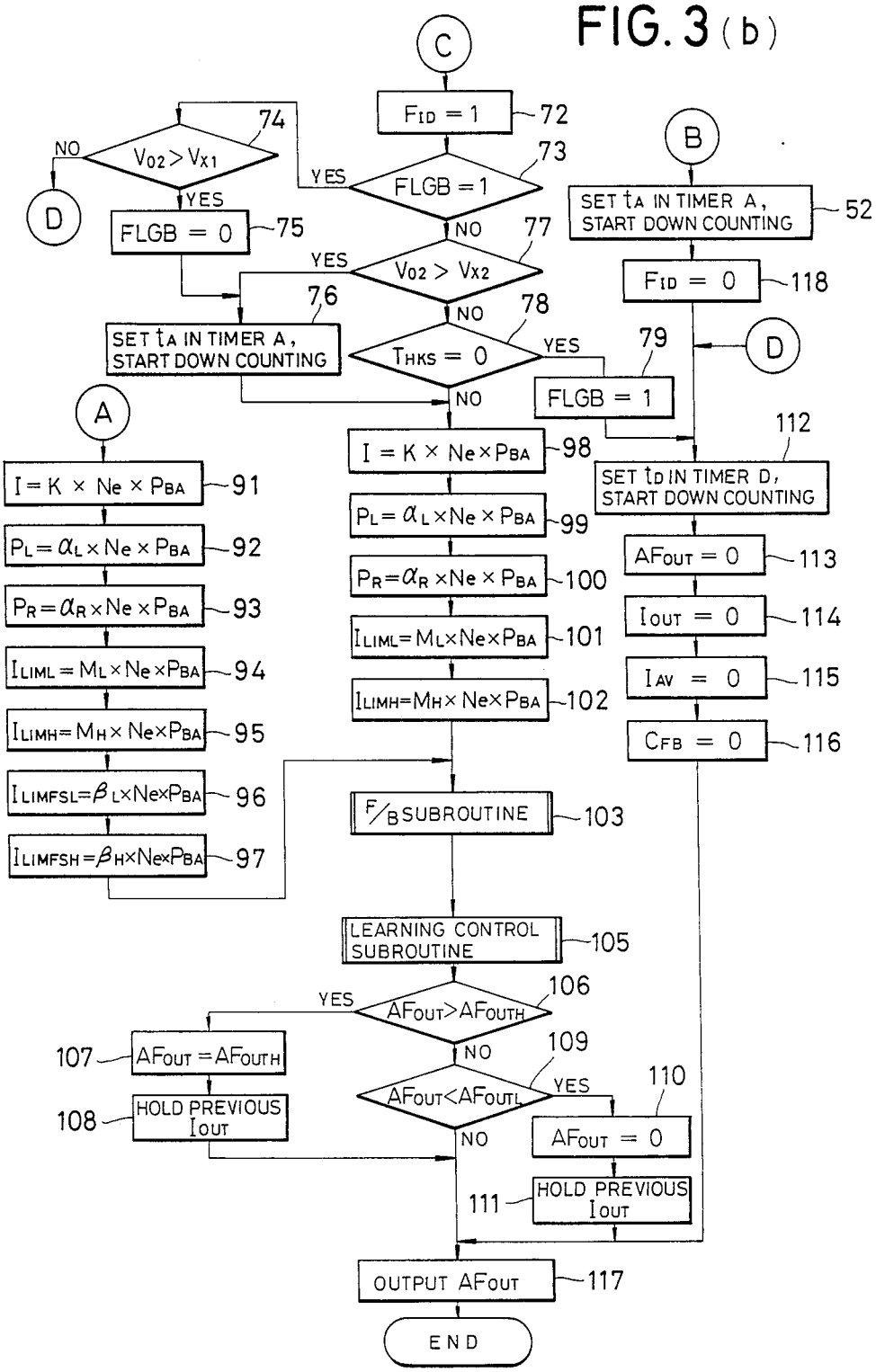

As shown in FIGS. 3(*a*) and 3(*b*), the CPU 29 at first reads the information of the absolute pressure $P_{BA}$, the cooling water temperature $T_W$, the intake air temperature $T_A$, the oxygen concentration $O_2$ in the exhaust gas, the vehicle speed V, the atmospheric pressure $P_A$, the engine speed Ne, information of the on/off state of the vacuum switch 7 and the clutch switch 18, at a step 50. Then, the CPU 29 detects as to whether or not the engine speed Ne is lower than a predetermined rotational speed $Ne_1$ (for example 3200 rpm) at a step 51.

If $Ne<Ne_1$, then the CPU 29 detects as to whether or not a difference pressure $P_A-P_{BA}$ between the atmospheric pressure $P_A$ and the absolute pressure $P_{BA}$ is greater than a predetermined pressure $P_{B1}$ (for example 80 mmHg) at a step 53. If $Ne\geqq Ne_1$, indicating that the engine speed is high, and if $P_A-P_{BA}\leqq P_{B1}$, indicating that the vacuum in the intake manifold is low, it is determined that the open loop control should be performed, and a predetermined time $t_A$ (for example, 30 seconds) is set in the timer A, and a down counting is started at a step 52, and further a value 0 is set to a flag $F_{ID}$ at a step 118.

If $P_A-P_{BA}>P_{B1}$, whether or not the intake air temperature $T_A$ is lower than a predetermined temperature $T_{A1}$ (for example, 75° C.) and higher than a predetermined temperature $T_{A2}$ (for example, 20.5° C., ($T_{A1}>T_{A2}$), is detected at steps 54 and 55. If $T_A\geqq T_{A1}$, indicating that the open loop control should be performed because of a high temperature, steps 52 and 118 are executed. On the other hand, if $T_A\leqq T_{A2}$, indicating that the intake air temperature is low, a value 1 is set to an intake air temperature flag FLGA at a step 56, and the steps 52 and 118 are executed subsequently.

If $T_{A2}<T_A<T_{A1}$, whether or not the flag FLGA is equal to 1 is detected at a step 57. If FLGA=0, indicating that the intake air temperature is not low, whether or not the cooling water temperature $T_W$ is higher than a predetermined temperature $T_{W1}$ (for example, 55° C. ($T_{A1}>T_{W1}>T_{A2}$)) is detected at a step 58. If FLGA=1, indicating that the intake air temperature is detected to be low, whether or not the cooling water temperature $T_W$ is higher than a predetermined temperature $T_{W2}$ (for example 75° C. ($T_{W2}>T_{W1}$)) is detected at a step 59.

If $T_W>T_{W1}$, whether or not the vacuum switch 7 is turned on is detected at a step 61. On the other hand, if $T_W>T_{W2}$, the flag FLGA is reset to 0 at a step 60, and the step 61 is executed subsequently. If the vacuum switch is turned off, indicating that the throttle valve 3 is open, it is determined that condition for the air/fuel ratio feedback control is satisfied, and a predetermined time $t_A$ is set in the timer A, and the down counting is started at a step 62, an activation flag FLGB is set to 0 at a step 63, and further the flag $F_{ID}$ is reset to 0 at a step 119. If the vacuum switch 7 is turned on, indicating that the throttle valve 3 is closed, whether or not the engine speed Ne is lower than a predetermined rotational speed $Ne_2$ (for example, 400 rpm ($Ne_1>NE_2$), is detected at a step 64. If Ne<Ne2, indicating that the engine is in the cranking state, then a predetermined time period $t_B$ (for example, 5 seconds) is set to the timer B, to start the down counting at a step 65, and steps 52 and 118 are executed subsequently. If $Ne \geqq Ne_2$, whether or not count value $T_{ST}$ of the timer B has reached 0 is detected at a step 66. If $T_{ST}>0$, indicating that the predetermined time period $t_B$ has not elapsed after the completion of the cranking operation, a value 1 is set to a flag $F_{ST}$ at a step 67, and the steps 52 and 118 are executed subsequently.

On the other hand, when the predetermined time period $t_B$ has elapsed after the completion of the cranking operation, and $T_{ST}=0$, whether or not the engine speed Ne is lower than a predetermined rotational speed $Ne_3$ (for example, 600 rpm), and vehicle speed V is lower than a predetermined speed $V_1$ (for example, 64 km/h) is detected at steps 68 and 69. If $Ne<Ne_3$, indicating that the engine speed is low, and if $V \geqq V_1$ although $Ne \geqq Ne_3$, indicating that the vehicle is decelerating at a high vehicle speed, the steps 52 and 118 will be executed in order to perform the open loop control. If $V<V_1$ with $Ne \geqq Ne_3$, whether or not the vehicle speed V is lower than a predetermined speed $V_2$ (for example, 3 Km/h ($V_1>V_2$)), and the rotational speed of the engine Ne is lower than a predetermined rotational speed $Ne_4$ (for example, 1000 rpm) are detected at steps 70 and 71. If $V \geqq V_2$, or $Ne \geqq Ne_4$, indicating that the condition for the feedback control of the air/fuel ratio is satisfied, steps 62, 63 and 119 will be executed. If $V<V_2$, or $Ne<Ne_4$, it is determined that the engine is idling, a value 1 is set to the idle flag $F_{ID}$ at a step 72, and whether or not the activation detection flag FLGB is equal to 1 is detected at a step 73. If FLGB=1, this is because either it is already determined that the oxygen concentration sensor 14 is inactive, or the value 1 is set to the flag FLGB by the initiation operation immediately after the turning on of the ignition switch. Therefore, whether or not an output voltage $VO_2$ of the oxygen concentration sensor 14 is higher than a predetermined voltage $Vx_1$(for example, 0.7 V) is detected at a step 74. When this detection is performed, the air/fuel ratio is controlled by the open loop control operation, and the solenoid valve 9 is in closed state. Therefore, the air/fuel ratio of the mixture supplied to the engine is made rich. Therefore, the output voltage $VO_2$ of the oxygen concentration sensor 14 should be higher than the predetermined voltage $Vx_1$. Whereas, if $VO_2 \leqq Vx_1$, it is determined that activation of the oxygen concentration sensor 14 has not completed, and the open loop control will be continued. If $VO_2>Vx_1$, it can be regarded that the oxygen concentration sensor 14 is in the activated state, thereby determining that the condition for the air/fuel ratio feedback control under idling condition is satisfied, and the flag FLGB is reset to 0 at a step 75, and the predetermined time period $t_A$ is set to the timer A, to start the down counting at a step 76.

If FLGB=0 at the step 73, indicating that the oxygen concentration sensor 14 has once been detected to be in the activated state, whether or not the output voltage $VO_2$ of the oxygen concentration sensor 14 is higher than a predetermined voltage $Vx_2$ (for example, 0.2 V ($Vx_1>Vx_2$)) at a step 77. If $VO_2>Vx_2$, indicating that the oxygen concentration sensor 14 is still activated, the step 76 is executed to perform the feedback control of the air/fuel ratio. However, if $VO_2 \leqq Vx_2$, indicating that there is a possibility that the oxgyen concentration sensor 14 has become inactive again, whether or not a measuring value $T_{HKS}$ of the timer A has reached 0 is detected at a step 78. If $T_{HKS}>0$, indicating that the condition in which the condition of $VO_2 \leqq Vx_2$ has not continued for more than the predetermined time period $t_A$, the feedback control of the air/fuel ratio will be continued. If $T_{HKS}=0$, indicating that the condition in which $VO_2 \leqq Vx_2$ has continued for more than the predetermined time period $t_A$, and the oxygen concentration sensor 14 has become inactive, a value 1 is set to the flag FLGB at a step 79 so as to execute the open loop control. Specifically, if for example the oxygen concentration sensor 14 is cooled down during the feedback control of the air/fuel ratio under a low load condition of the engine such as in the idling period of the engine and it has become impossible to obtain a desired output characteristic of the oxygen concentration sensor, the output voltage $VO_2$ of the oxygen concentration sensor 14 will be dropped for every detection region so that the air/fuel ratio of the mixture is detected to be lean from the output voltage $VO_2$ even though the actual air/fuel ratio of the supplied mixture is rich. In such a case the solenoid valve 9 will be closed to enrich the air/fuel ratio of the supplied mixture. However, if the output voltage $VO_2$ of the oxgyen concentration sensor 14 remains lower than the predetermined voltage $Vx_2$ even though the air/fuel ratio of the supplied mixture has turn to be rich, it can be determined that the oxygen concentration sensor 14 is inactive.

On the other hand, if $Tw \leqq Tw_1$ at the step 58, whether or not the vehicle speed V is higher than a predetermined speed $V_3$ (for example, 35 Km/h) at a step 80. If $V>V_3$, whether or not the clutch switch 18 is turned on is detected at a step 81. If the clutch switch 18 is turned on, indicating that the clutch is engaged, whether or not the vacuum switch 7 is turned on is detected at a step 82. If $V>V_3$ although $Tw \leqq Tw_1$, and the vacuum switch 7 is turned off by the opening of the throttle valve 3 and the clutch is engaged at the same time, steps 62, 63, and 119 will be executed to perform the open loop control.

On the other hand if any one of the conditions of, $V \leqq V_3$, turning off of the clutch switch 18, turning on of the vacuum switch 7, is satisfied through $Tw \leqq Tw_1$, steps 52 and 118 will be executed to perform the open loop control. Further, if $Tw \leqq Tw_2$ in the step 59, steps 52 and 118 are also executed.

Figure 4:
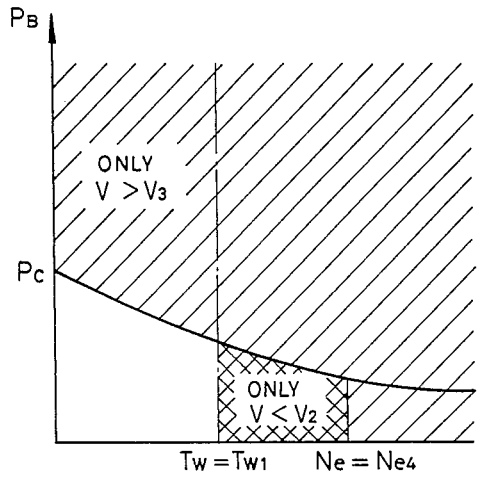
FIGS. 4(*a*) and 4(*b*) are diagrams showing regions of the feedback control of the air/fuel ratio.
Figure 4:
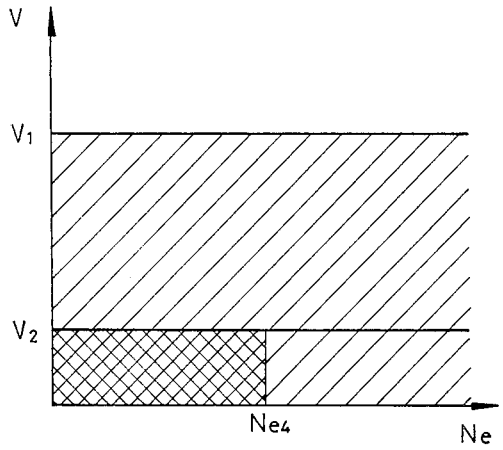

FIG. 4(*a*) shows the feedback control region, and FIG. 4(*b*) shows a feedback control region which is determined by the vehicle speed V and the engine speed Ne under a condition in which the vacuum switch 7 is turned on. In these figures, the area indicated by cross-hatching represents the region of the feedback control of the air/fuel ratio during the idling period, and the area indicated by hatching represents the region of the feedback control of the air/fuel ratio in a state other than the idling of the engine.

If condition for the feedback control in the state other than the idling of the engine is satisfied, after the execution of the step 119, an integration value I and proportional values $P_L$, $P_R$ are calculated at steps 91, 92, and 93 as shown in FIG. 3(*b*). The integration value I is calculated by using an equation $I=K\times Ne\times P_{BA}$. The proportional value $P_L$ for lean state is calculated by using an equation of $P_L=\alpha L\times Ne\times P_{BA}$, and the proportional value $P_R$ for rich state is calculated by using an equation of $P_R=\alpha R\times Ne\times P_{BA}$. K, $\alpha$L, $\alpha$R are constants, and $\alpha L\neq\alpha R$. Also, a lower limit value $I_{LIML}$ and an upper limit value $I_{LIMH}$ of the air/fuel ratio correction value $I_{OUT}$ to be used in the feedback control of the air/fuel ratio are calculated at steps 94 and 95 respectively. Further, a lower limit value $I_{LIMFSL}$ and an upper limit value $I_{LIMFSH}$ of the air/fuel ratio correction value $I_{OUT}$ for a failure diagnosis of the oxygen concentration detection system are calculated at steps 96 and 97 respectively. The lower limit value $I_{LIML}$ is calculated by using a formula $M_L\times Ne\times P_{BA}$, and the upper limit value $I_{LIMH}$ is calculated by using a formula $M_H\times Ne\times P_{BA}$. On the other hand, the lower limit value $I_{LIMFSL}$ is calculated by using a formula $\beta L\times Ne\times P_{BA}$, and the upper limit value $I_{LIMFSH}$ is calculated by using a formula $\beta H\times Ne\times P_{BA}$. $M_L$, $M_H$, $\beta$L, and $\beta$H are constants, and $M_L\neq M_H$, and $\beta L\neq\beta H$.

If the condition for the feedback control of the air/fuel ratio during the idling of the engine is satisfied, the integration value I, proportional values $P_L$ and $P_R$ will be calculated after the execution of the steps 76 and 78, in steps 98, 99, and 100 like in the steps 91, 92, and 93. Since the engine speed Ne and the absolute pressure $P_{BA}$, in the idling state of the engine, have lower values than other operational states of the engine, the integration value L, the proportional value $P_L$, $P_R$ will become small in the idling state of the engine. Further, the lower limit value $I_{LIML}$ and the upper limit value $I_{LIMH}$ of the air/fuel ratio correction value $I_{OUT}$ are calculated at steps 101 and 102 respectively.

After the execution of the step 97 or 102, an F/B (feedback) subroutine for calculating an output value $AF_{OUT}$ of the air/fuel ratio control, and a learning control subroutine for calculating an error of the base value $D_{BASE}$ due to a change of the carburetor caused by the lapse of time, are executed through steps 103 and 105 respectively. Subsequently, whether or not the output value $AF_{OUT}$ of the air/fuel ratio control is higher than the upper limit value $AF_{OUTH}$ (for example, F00 in hexadecimal number system) is detected at a step 106. If $AF_{OUT}>AF_{OUTH}$, then the output value of the air/fuel ratio control $AF_{OUT}$ is made equal to the upper limit value $AF_{OUTH}$ at a step 107, and the air/fuel ratio correction value $I_{OUT}$ is made equal to a previous air/fuel ratio correction value $I_{OUT}$ obtained through a previous processing cycle and held at a step 108. If $AF_{OUT}\leqq AF_{OUTH}$, then whether or not the output value of the air/fuel ratio control $AF_{OUT}$ is smaller than the lower limit value $AF_{OUTL}$ (for example, 200 in a hexadecimal number system) is detected at a step 109. If $AF_{OUT}<AF_{OUTL}$, the output value of the air/fuel ratio control $AF_{OUT}$ is made equal to 0 at a step 110, and the air/fuel ratio correction value $I_{OUT}$ is made equal to the previous air/fuel ratio correction value $I_{OUT}$ obtained through the previous processing cycle and held at a step 111. If $AF_{OUT}\geqq AF_{OUTL}$, then the output value of the air/fuel ratio control $AF_{OUT}$ calculated through the F/B subroutine is retained.

If the condition for the feedback control of the air/fuel ratio is not satisfied and the open loop control of the air/fuel ratio is to be performed, a predetermined time period $t_D$ (for example, 60 seconds) is set to the timer D, and the down counting is started at a step 112, the output value of the air/fuel ratio control $AF_{OUT}$ is made equal to 0 at a step 113, the air/fuel ratio correction value $I_{OUT}$ is made equal to 0 at a step 114, a renewal addition value $I_{AV}$ is made equal to 0 at a step 115, and the count value $C_{FB}$ is made equal to 0 at a step 116.

After determining the output value of the air/fuel ratio control $AF_{OUT}$ in this way, the output value $AF_{OUT}$ is outputted to the drive circuit 28 at a step 117.

The drive circuit 28 is constructed to detect the value of the current flowing through the solenoid 9*a* of the solenoid value 9 by means of the current detection resistor, and to compare the detected current value with output value $AF_{OUT}$, and to control the drive transistor in an on/off manner in accordance with the result of the comparison, to supply the current to the solenoid 9*a*.

Therefore, the current having a magnitude represented by the output value $AF_{OUT}$ flows through the solenoid 9*a*, and an opening of the solenoid valve which is proportional to the value of the current flowing through the solenoid 9*a* will be obtained. As a result, the intake side secondary air of an amount corresponding to the output value $AF_{OUT}$ is supplied into the intake manifold 4. On the other hand, if the output value $AF_{OUT}$ is equal to 0, then the solenoid valve 9 is closed to stop the supply of the intake side secondary air.

Figure 5:
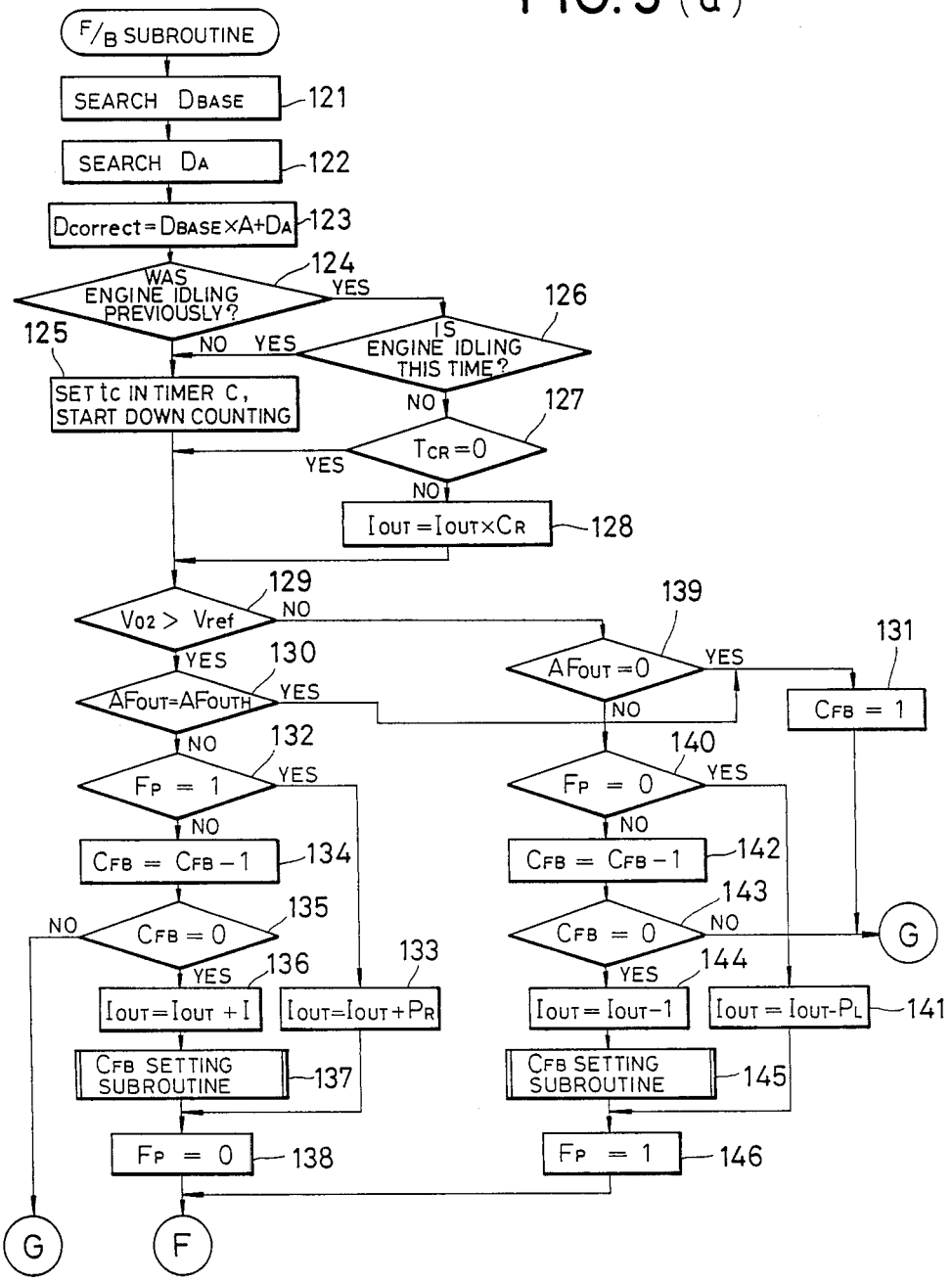
Figure 5:
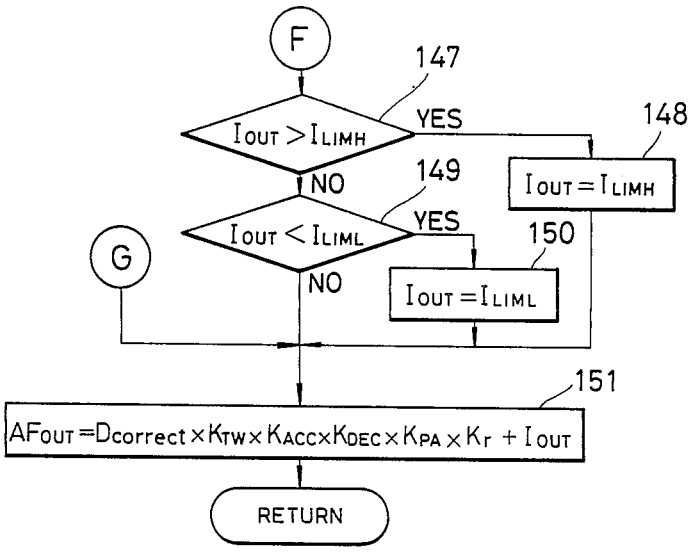

Next, in the F/B subroutine shown in FIGS. 5(*a*) and 5(*b*), the base value $D_{BASE}$ of the air/fuel ratio control and a base correction value $D_A$ are searched at steps 121 and 122 respectively. In the ROM 30, values of the base value $D_{BASE}$ determined by the absolute pressure $P_{BA}$ and the engine speed Ne are previously stored as a $D_{BASE}$ data map. On the other hand, in the RAM 31, values of the base correction value $D_A$ determined by the absolute pressure $P_{BA}$ and the engine speed Ne are formed as a $D_A$ data map by the leaning control which will be described later. The CPU 29 searches a value of the base value $D_{BASE}$ from the $D_{BASE}$ data map, and a value of the base correction value $D_A$ from the $D_A$ data map both corresponding to read values of the absolute pressure $P_{BA}$ and the engine speed Ne, respectively. In addition, the base value $D_{BASE}$ is set by interpolation for values between meshes of the $D_{BASE}$ data map, and the same base correction value $D_A$ is set for each unit of region determined in the $D_A$ data map.

Affter setting the base value $D_{BASE}$ and the base correction value $D_A$ in this way, the base value $D_{BASE}$ is corrected by means of the base correction value $D_A$, to generate a base value Dcorrect at a step 123. Specifically, the base value Dcorrect is obtained in accordance with an equation $Dcorrect=D_{BASE}\times A+D_A$, in which A is a constant (for example, 10 in hexadecimal number system). Subsequently, whether or not the idling state was detected in the previous processing cycle, is detected at a step 124. If the result of detection indicates that an operation state other than the idling state was detected in the previous processing cycle, a predetermined time period $t_C$ (for example, 100 milliseconds) is set to the timer C, to start the down counting at a step 125. If the idling state has been detected in the previous processing cycle, then whether or not the engine is in the idling state in the present processing cycle is detected by the content of the flag $F_{ID}$ at a step 126. If the idling state is detected in the present processing cycle, the step 125 is executed.

On the other hand, any operational state other than the idling state was detected in the present processing cycle, whether or not the measuring value $T_{CR}$ of the timer C has reached 0 is detected at a step 127. If $T_{CR}>0$, indicating that more than the time period $t_C$ has not elapsed after the operational state has shifted from the idling state to the other operational state, a correction coefficient $C_R$ (for example, 1.5) is multiplied to the air/fuel ratio correction value $I_{OUT}$, and the calculated value is determined to be a new air/fuel ratio correction value $I_{OUT}$ at a step 128. After the elapse of the predetermined time period $t_C$, the correction operation for multiplying the correction coefficient to the air/fuel ratio correction value $I_{OUT}$ will not be executed. In addition, the step 124 is, for example, executed by using a flag which memorizes that the content of the flag $F_{ID}$ was 1 in the previous processing cycle.

Next, whether or not the output voltage $VO_2$ of the oxygen concentration sensor 14 is higher than a reference voltage Vref (for example, 0.5 V ($Vx_2<V$-ref$<Vx_1$)) is detected at a step 129. If $VO_2>$Vref, indicating that the air/fuel ratio of the supplied mixture is richer than the stoichiometric air/fuel ratio, whether or not the output value $AF_{OUT}$ of the air/fuel ratio control in the previous processing cycle was equal to the upper limit value $AF_{OUTH}$ is detected at a step 130. If $AF_{OUT}=AF_{OUTH}$, the count value $C_{FB}$ is made equal to 1 at a step 131. If $AF_{OUT}\neq AF_{OUTH}$, then whether or not the flag $F_P$ is equal to 1 is detected at a step 132. If $F_P=1$, indicating that the present operation is immediately after the air/fuel ratio has turned from lean to rich with respect to the stoichiometric air/fuel ratio, the proportional value $P_R$ is added to the air/fuel ratio correction value $I_{OUT}$, and the calculated value is determined to be a new air/fuel ratio correction value $I_{OUT}$, at a step 133. If $F_P=0$, indicating that the air/fuel ratio has been continuously rich, a value 1 is subtracted from the count value $C_{FB}$ at a step 134, and whether or not the count value $C_{FB}$ after the subtraction is equal to 0 is detected at a step 135. If $C_{FB}=0$, then the integration value I is added to the air/fuel ratio correction value $I_{OUT}$, and the calculated value is made as a new air/fuel ratio correction value $I_{OUT}$ at a step 136, and a $C_{FB}$ setting subroutine for setting the count value $C_{FB}$ is executed at a step 137. After the execution of the steps 133 and 137, a value 0 is set to the flag $F_P$ for indicating that the air-fuel ratio was in the rich state during the present processing cycle, at a step 138.

On the other hand, if $VO_2\leqq$Vref, indicating that the air/fuel ratio of the supplied mixture is leaner than the stoichiometric air/fuel ratio, whether or not the output value $AF_{OUT}$ of the air/fuel ratio control in the previous processing cycle is equal to 0 is detected at a step 139. If $AF_{OUT}=0$, the count value $C_{FB}$ is made equal to 1 at a step 131. If $AF_{OUT}\neq 0$, whether or not the flag $F_P$ is equal to 0 is detected at a step 140. When $F_P=0$, indicating that the operational state is immediately after that the air/fuel ratio has turned from rich to lean with respect to the stoichiometric air/fuel ratio, the proportional value $P_L$ is subtracted from the air/fuel ratio correction value $I_{OUT}$, and the calculated value is made as a new air/fuel ratio correction value $I_{OUT}$ at a step 141. When $F_P=1$, indicating that the air/fuel ratio is maintained in the lean state, the value 1 is subtracted from the count value $C_{FB}$ at a step 142, and whether or not the count value $C_{FB}$ after the subtraction is equal to 0 is detected at a step 143. If $C_{FB}=0$, the integration value I is subtracted from the air/fuel ratio correction value $I_{OUT}$, and the calculated value is made as the new air/fuel ratio correction value $I_{OUT}$ at a step 144, and further the $C_{FB}$ setting subroutine for setting $C_{FB}$ is executed at a step 145.

After the execution of the step 141 or 145, the flag $F_P$ is reset to 1 at a step 146 so as to indicate that the air/fuel ratio was in the lean state during the present processing cycle. After the execution of the step 138 or the step 146, whether or not the calculated air/fuel ratio correction value $I_{OUT}$ is greater than the upper limit value $I_{LIMH}$ at a step 147. If $I_{OUT}=I_{LIMH}$, then the air/fuel ratio correction value $I_{OUT}$ is made equal to the upper limit value $I_{LIMH}$ at a step 148. If $I_{OUT}\leqq I_{LIMH}$, then whether or not the calculated air/fuel ratio correction value $I_{OUT}$ is smaller than the lower limit value $I_{LIML}$ at a step 149. If $I_{OUT}<I_{LIML}$, the air/fuel ratio correction value $I_{OUT}$ is made equal to the lower limit value $I_{LIML}$ at a step 150. If $I_{OUT}\geqq I_{LIML}$, the calculated air/fuel ratio correction value $I_{OUT}$ is maintained. Furthermore, if $C_{FB}\neq 0$ at the step 135 or the step 143, the present air/fuel ratio correction value $I_{OUT}$ is maintained.

By using the thus determined air/fuel ratio correction value $I_{OUT}$, the output value $AF_{OUT}$ of the air/fuel ratio control is calculated at a step 151. The output value $AF_{OUT}$ of the air/fuel ratio control is be calculated by using the following equation.

$$AF_{OUT}=\text{Dcorrect}\times K_{TW}\times K_{ACC}\times K_{DEC}\times K_{PA}\times \text{Kr}+I_{OUT} \quad (1)$$

in which $K_{TW}$ is a cooling water temperature increment coefficient, $K_{ACC}$ is an acceleration increment coefficient, $K_{DEC}$ is a deceleration decrement coefficient, $K_{PA}$ is an atmospheric pressure correction coefficient, and Kr is a high altitude intake vacuum correction coefficient. These coefficients can be set by calculations in each subroutine, or by searching from a data table.

Figure 6:
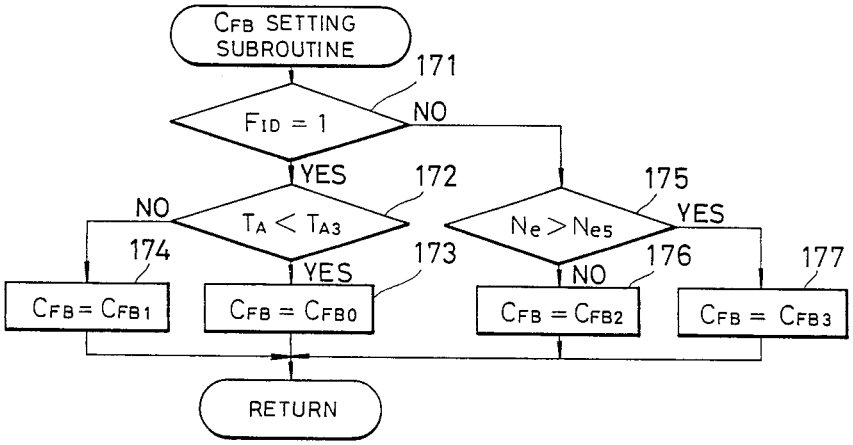

In the $C_{FB}$ set subroutine at the step 137 or the step 145, whether or not the flag FID is equal to 1 is detected at a step 171 as shown in FIG. 6. If $F_{ID}=1$, indicating that the engine is idling, whether or not the intake air temperature $T_A$ is lower than a predetermined temperature $T_{A3}$ (for example, 60° C., ($T_{A2}<T_{A3}<T_{A1}$)) is detected at a step 172. If $T_A<T_{A3}$, the count value $C_{FB}$ is made equal to a predetermined value $C_{FB0}$ at a step 173. If $T_A\geqq T_{A3}$, the count value is made equal to a predetermined value $C_{FB1}$ ($C_{FB0}>C_{FB1}$) at a step 174. On the other hand, if $F_{ID}=0$, indicating that the state of the engine operation is other than the idling state, whether or not the engine speed Ne is higher than the predetermined rotational speed $Ne_5$ is detected at a step 175. If $Ne\leqq Ne_5$, the count value $C_{FB}$ is made equal to a predetermined value $C_{FB2}$ at a step 176. On the other hand, if $Ne>Ne_5$, the count value $C_{FB}$ is made equal to a predetermined value $C_{FB3}$ ($C_{FB2}>C_{FB3}$) at a step 177. The predetermined values $C_{FB0}$ and $C_{FB1}$ are determined to be greater than the predetermined values $C_{FB2}$ and $C_{FB3}$. Therefore, in the idling state, the number of times of execution of the step 136 or 144 per time becomes small than the other operational states, and the speed of the change in the air/fuel ratio correction value $I_{OUT}$ by the integral control, that is, the speed of adjustment, becomes low in the idling state. Furthermore, the predetermined value $C_{FB1}$ is determined to be smaller than the predetermined value $C_{FB0}$. Therefore, the number of execution of the step 136 or the step 144 per time becomes large when the intake air temperature is high in the idling state, so that the speed of the change in the air/fuel ratio correction value $I_{OUT}$ by the integral control operation, that is, the speed of adjustment, will become high. In addition, although the count value $C_{FB}$ is set in accordance with the value of the rotational speed of the engine Ne in the step 175, it is also possible to set the count value $C_{FB}$ in accordance with magnitude of the difference pressure $P_A-P_{BA}$.

Figure 7:
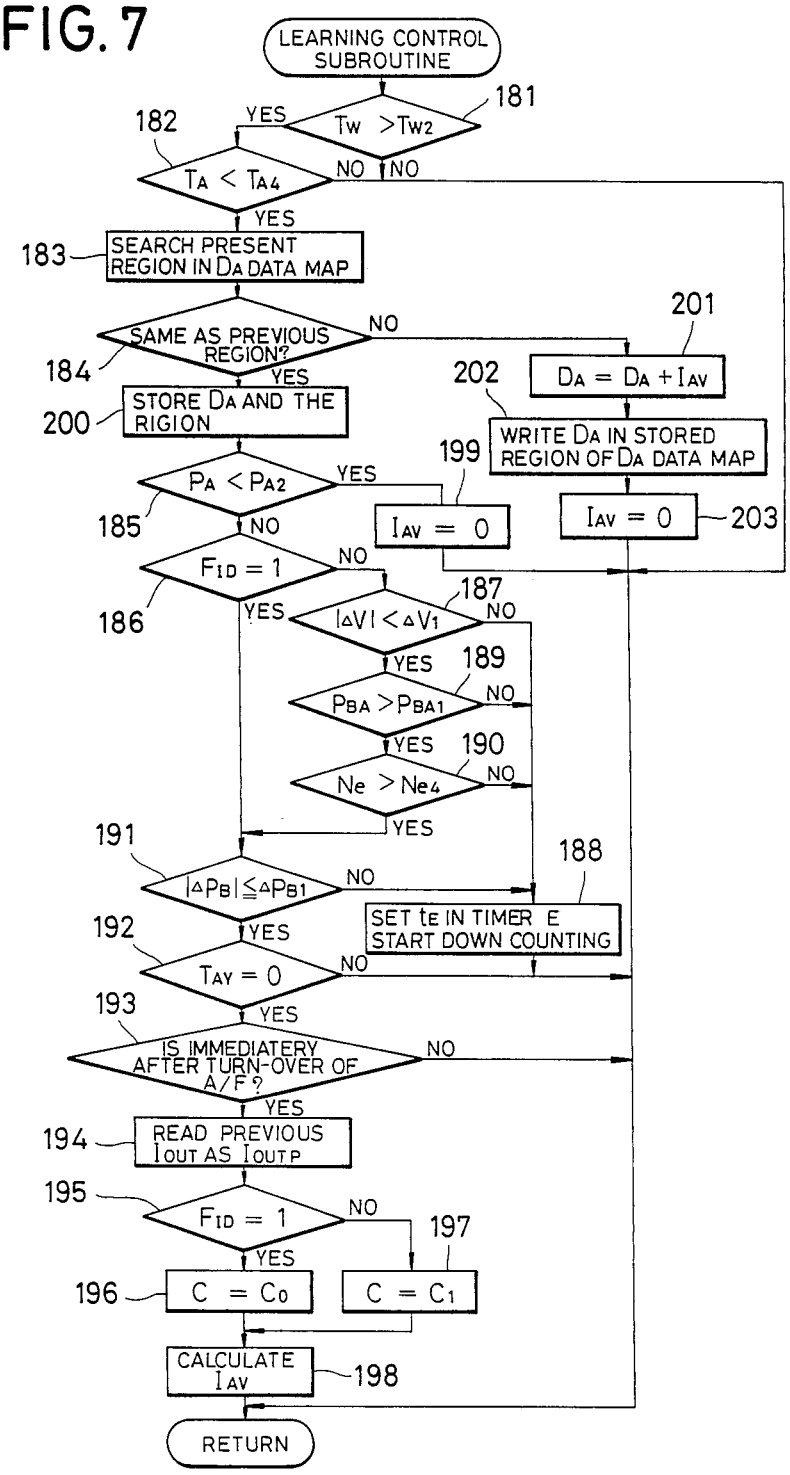

In the learning control subroutine, as shown in FIG. 7, whether or not the cooling water temperature $T_W$ is higher than the predetermined temperature $T_{W2}$ is detected at a step 181. If $T_W>T_{W2}$, whether or not the intake air temperature $T_A$ is lower than a predetermined temperature $T_{A4}$ (for example, 60° C.) is detected at a step 182. If $T_A>T_{A4}$, a region in the $D_A$ data map corresponding to the read values representing the present engine speed Ne and the present absolute pressure $P_{BA}$, is searched out at a step 183. Furthermore, whether or not the searched region is identical with a region which was searched out through the previous processing routine, is detected at a step 184. If the region searched out present time is identical with the previous region, the base correction value $D_A$ searched at the step 122 is stored together with the data of the region in a predetermined memory location of the RAM 31 at a step 200, and whether or not the atmospheric pressure $P_A$ is smaller than a predetermined pressure $P_{A2}$ (for example, 700 mmHg) is detected at a step 185. If $P_A>P_{A2}$, the vehicle is at high altitude, and proper execution of the learning control of the base correction value $D_A$ is not possible. Therefore, the renewal addition value $I_{AV}$ is made equal to 0 at a step 199 in order to inhibit the renewing of the base correction value $D_A$.

On the other hand, if $P_A \geqq P_{A2}$, whether or not the flag $F_{ID}$ is equal to 1 is detected at a step 186. If $F_{ID}=0$, indicating that the operational state is other than the idling state, whether or not an absolute value $|\Delta V|$ of the amount of change $\Delta V$ of the vehicle speed V per unit time is smaller than a predetermined value $\Delta V_1$ (for example, 0.5 Km/h) is detected at a step 187. If $|\Delta V| \geqq \Delta V_1$, a predetermined time $t_E$ is set to the timer E and down counting is started at a step 188. If $|\Delta V|<\Delta V_1$, whether or not the absolute pressure $P_{BA}$ is greater than a predetermined pressure $P_{BA1}$ (for example, 260 mmHg), and whether or not the engine speed Ne is higher than a predetermined rotational speed $Ne_4$, are detected respectively at steps 189 and 190. If $P_{BA} \leqq P_{BA1}$, or $Ne \leqq Ne_4$, the step 188 will be executed. If $P_{BA}>P_{BA1}$ and $Ne>Ne_4$ at the same time, or if $F_{ID}=1$ at the step 186 under the idling condition, whether or not an absolute value $|\Delta P_B|$ of the amount of change $\Delta P_B$ of the absolute value $P_{BA}$ per unit time is equal to or smaller than a predetermined value $\Delta P_{B1}$ is detected at a step 191. If $|\Delta P_B|>\Delta P_{B1}$, the step 188 is executed. If $|\Delta P_B| \leqq \Delta P_{B1}$, whether or not the measuring value $T_{AV}$ of the timer E has reached 0 is detected at a step 192. If $T_{AV}=0$, whether or not the operational state is immediately after the air/fuel ratio of the supplied mixture has changed from rich to lean, or vice versa with respect to the stoichiometric air/fuel ratio, is detected at a step 193. If, in the present processing cycle, the step 133 or the step 141 has been executed, it can be regarded that the air/fuel ratio has turned over with respect to the stoichiometric air/fuel ratio. Therefore, in such a case the air/fuel ratio correction value $I_{OUT}$ which has been set through the previous processing cycle is read out as $I_{OUTP}$ at a step 194, and whether or not the flag $F_{ID}$ is equal to 1 is detected at the step 195. If $F_{IB}=1$, indicating that the engine is idling, a constant C is made equal to a predetermined value $C_0$ (for example, 3) at a step 196. If $F_{ID}=0$, indicating that the operational state is other than the idling state, the constant C is made equal to a predetermined value $C_1$ (for example, 1 ($C_0>C_1$)) at a step 197. After setting the constant C, the renewal addition value $I_{AV}$ is calculated by using the constant C at a step 198. The renewal addition value $I_{AV}$ is calculated according to the following equation.

$$I_{AV}=C\times I_{OUTP}/256+(256-C)\times I_{AV}/256 \quad (2)$$

If the region searched out from the $D_A$ data map is not identical with the region searched out by the previous processing cycle at the step 184, the renewal addition value $I_{AV}$ calculated at the step 198 of the previous processing cycle is added to the base correction value $D_A$ which has been stored at the step 200 of the previous processing cycle, and the calculated value is made as a new base correction value $D_A$ at a step 201. The thus calculated base correction value $D_A$ is stored in the region of the $D_A$ data map which has been searched out through the previous processing cycle, at a step 202, and the renewal addition value $I_{AV}$ is made equal to 0, at a step 203.

In the air/fuel ratio control method according to the present invention, the constant (renewal constant) C is set to be the predetermined value $C_0$ in the idling state, which value is greater than the predetermined $C_1$ for operational states other than the idling state. Therefore, change in the renewal addition value $I_{AV}$ becomes greater at a rate corresponding to the increase in the constant C every time the renewal addition value (cumulative correction value) $I_A$ is calculated according to the equation (2). With this feature, even if the base correction value $D_A$ is greatly deviated from a proper value, its change towards the proper value is accelerated by a small number of times of calculation of the renewal addition value $I_{AV}$, and the renewal of the base correction value $D_A$ to the proper value can be completed in a short time.

In the above described embodiment of the present invention, the renewal addition value $I_{AV}$ of the base correction value $D_A$ is calculated at the step 198 every time the detected air/fuel ratio turns over, and the base correction value $D_A$ is renewed by using the renewal addition value $I_{AV}$ every time the operational state changes. However, the arrangement is not limited to the above, and it is also possible to calculate the base correction value $D_A$ in accordance with an equation $D_A=C\times I_{OUTP}/256+(256-C)\times D_A/256$, every time the detected air/fuel ratio turns over. Furthermore, instead of calculating the renewal addition value $I_{AV}$ or the base correction value $D_A$ only when the turn-over of the air/fuel ratio occurs, it is possible to calculate the renewal addition value $I_{AV}$ or the base correction value $D_A$ every time provided that $T_{AV}=0$ at the step 192.

As explained so far, in the first embodiment of the air/fuel ratio control method according to the present invention, the speed of change in the base correction value for correcting the base value of the air/fuel ratio control which is dominant in determining the air/fuel ratio control amount in the feedback control of the air/fuel ratio, is increases as the engine speed falls.

Therefore, the base correction value can be renewed quickly even if the engine speed falls, such as in the idling state, thereby improving the efficiency of the operation for purifying the exhaust gas.

Figure 8:
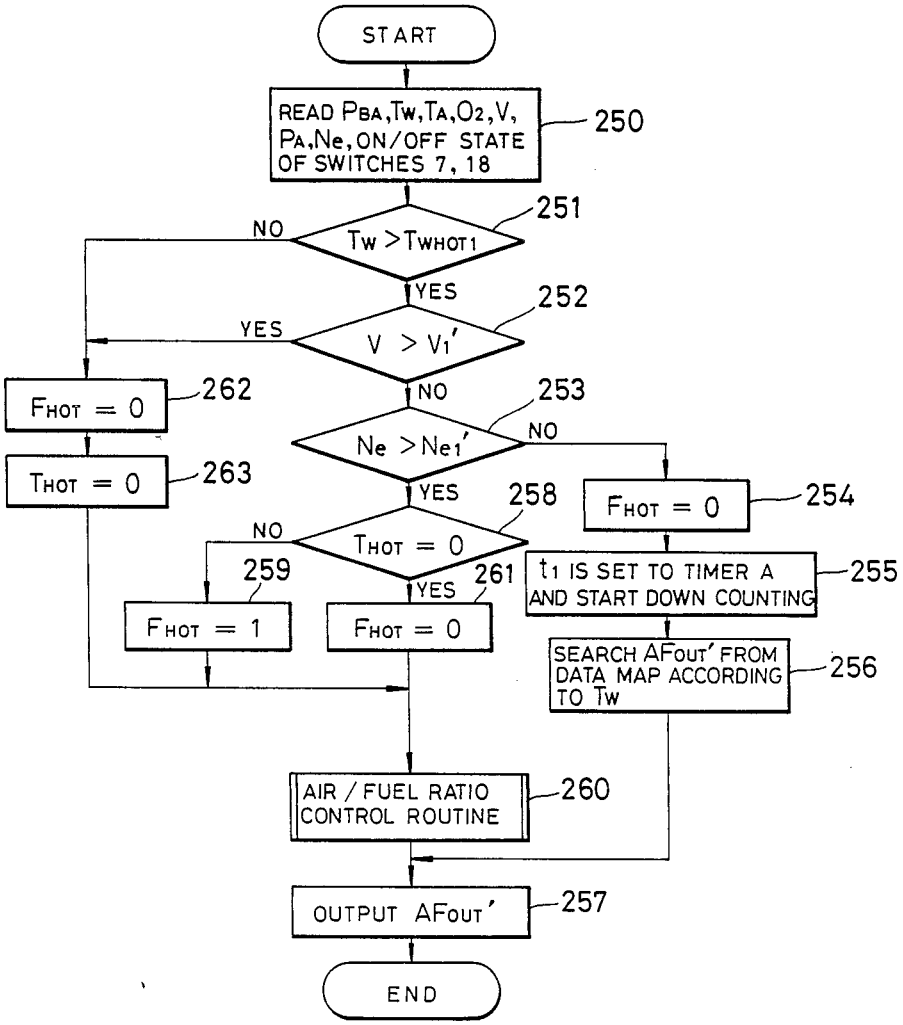
FIGS. 8 through 10 are flowcharts showing the manner of operation of the CPU in the control circuit shown in FIG. 2, in a second embodiment of the control method according to the present invention.
Figure 9:
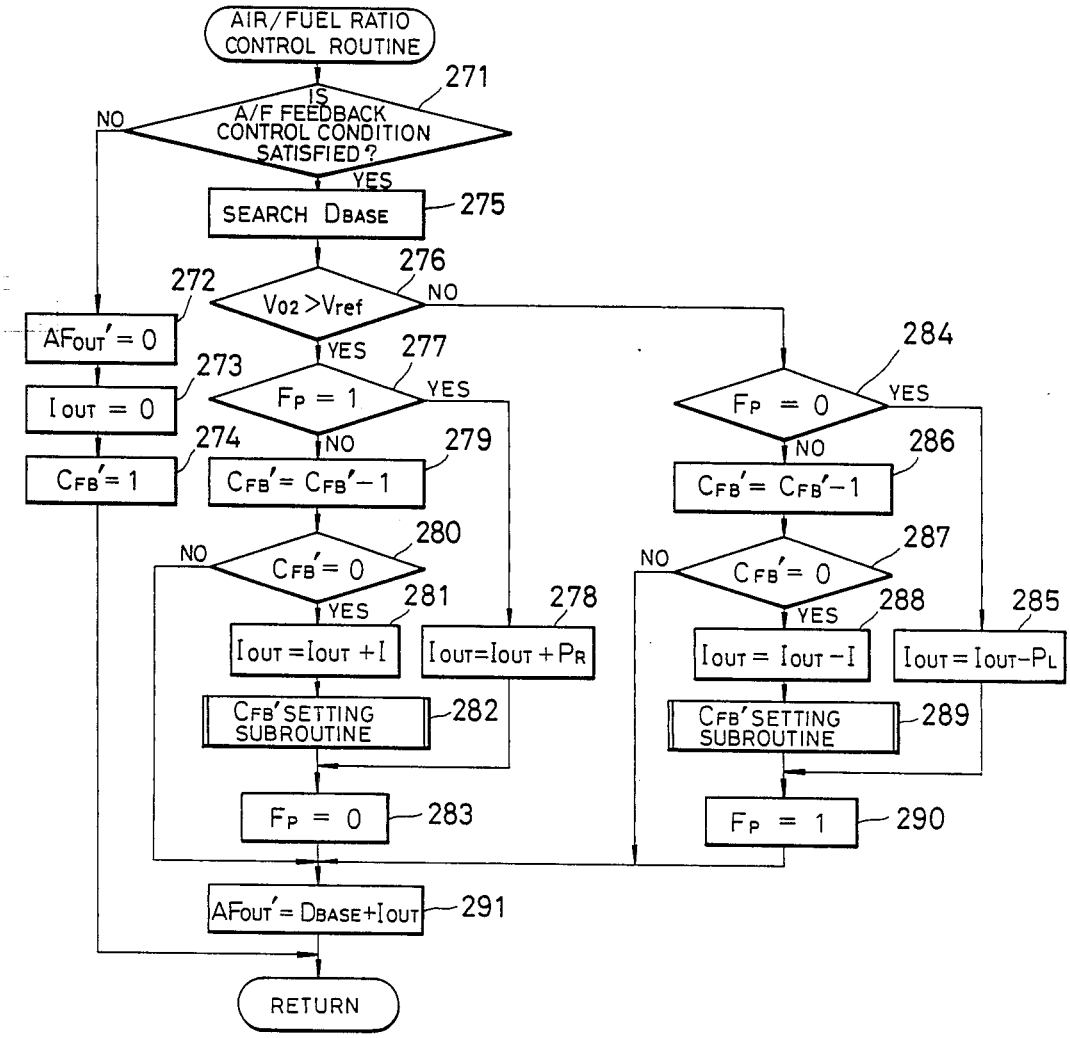
Figure 10:
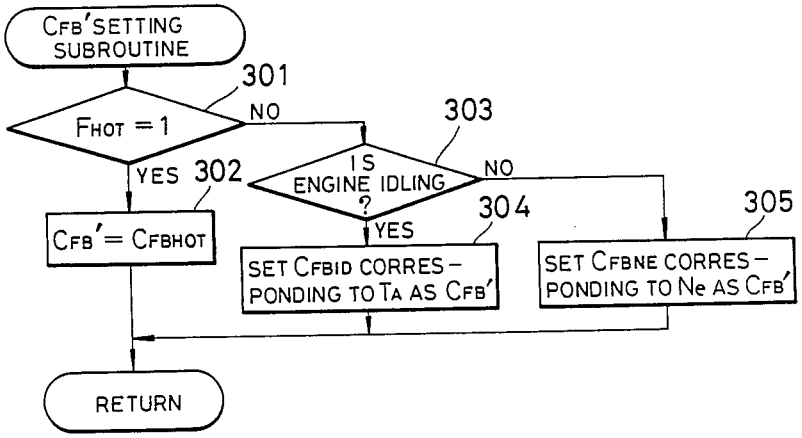

Referring to FIGS. 8 through 11 in which FIGS. 8 through 10 are flowcharts showing the operation of the CPU 29, the second embodiment of the air/fuel ratio control method according to the present invention will be explained hereinafter.

As shown in FIG. 8, the CPU 29 at first reads the information of the absolute pressure $P_{BA}$, the cooling water temperature $T_W$, the oxygen concentration $O_2$ in the exhaust gas, the vehicle speed V, the atmospheric pressure $P_A$, the engine speed Ne, and information of the on/off state of the vacuum switch 7 and the clutch switch 18, at a step 250. Then the CPU 29 detects as to whether or not the cooling water temperature $T_W$, as a parameter indicating the temperature of engine, is higher than a high engine temperature detection reference temperature $T_{WHOT1}$ (for example, 95° C.) at a step 251. If $T_W > T_{WHOT1}$, indicating that the engine temperature is high, the CPU 29 detects as to whether or not the vehicle speed V is higher than a low vehicle speed detection reference speed $V_1'$ (for example, 17 Km/h) at a step 252.

Figure 11:
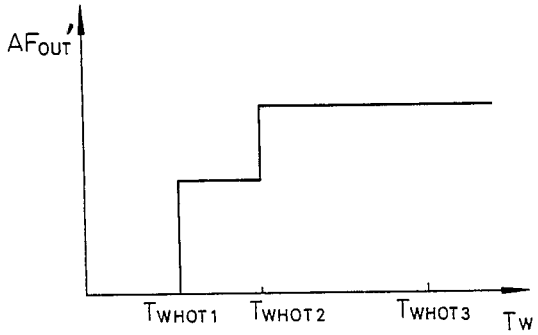
FIG. 11 is a diagram showing a Tw-$AF_{OUT'}$ characteristic in the second embodiment.

If $V \leqq V_1'$, indicating that the vehicle speed is low, including a state before the start of the vehicle, whether or not the engine rotation speed Ne is greater than a cranking speed $Ne_1'$ (for example 400 rpm) is detected at a step 253. If $Ne \leqq Ne_1'$, indicating the starting operation under a hot condition of the engine has not been completed, a flag $F_{HOT}$ is reset to 0 at a step 254. Then, a predetermined time $t_1$ (for example, 2 seconds) is set to the timer A, and the down counting is started, at a step 255, and an air/fuel ratio control output value $AF_{OUT}'$ is searched from the $AF_{OUT}'$ data map, at a step 256. The air/fuel ratio control output value $AF_{OUT}'$ represents the value of the current to be supplied to the solenoid 9a of the solenoid valve 9, and the $AF_{OUT}'$ data map is previously stored in the ROM 30 with such a $T_W - AF_{OUT}'$ characteristic as shown in FIG. 11. Therefore, the CPU 29 searches a value of the output value $AF_{OUT}'$ of the air/fuel ratio control corresponding to the cooling water temperature $T_W$ from the $AF_{OUT}'$ data map. In the $T_W - AF_{OUT}'$ characteristic of FIG. 11, $T_{WHOT2}$ is 100° C. for example, and $T_{WHOT3}$ is 110° C. for example.

After setting of the output value $AF_{OUT}'$ of the air/fuel ratio control by the searching operation, the output value $AF_{OUT}'$ is outputted to the drive circuit 28 at a step 257. By the open drive of the solenoid valve 9 by means of the drive circuit 28, the opening degree of the solenoid valve 9 becomes proportional to the value of the current flowing through the solenoid 9a, and the intake side secondary air of an amount corresponding to the output value $AF_{OUT}'$ is supplied into the intake manifold 4 in the case of the starting of the engine under a hot condition.

On the other hand, if $Ne > Ne_1'$ at the step 253, indicating that the starting operation of the engine under the hot condition has been completed, whether or not the measuring value $T_{HOT}$ of the timer A has reached 0 is detected at a step 258. If $T_{HOT} > 0$, indicating that the predetermined time $t_1$ has not lapsed after the completion of the starting operation of the engine, a value 1 is set to the flag $F_{HOT}$ at a step 259, and an air/fuel ratio control routine is executed subsequently at a step 260.

On the other hand, if $T_{HOT} = 0$, indicating that the time period $t_1$ has lapsed after the completion of the starting operation of the engine, the flag $F_{HOT}$ is reset to 0 at a step 261, and the program proceeds to the step 260 to execute the air/fuel ratio control routine.

Furthermore, it is possible to arrange such that when $Ne > Ne_1'$ at the step 253, the program proceeds to the step 254 to continue the supply of the intake side secondary air under the hot starting condition until a predetermined time period $t_2$ (for example, 1 second) or a time period $t_{HOT}$ corresponding to the cooling water temperature $T_W$ lapses, and proceeds to the step 258 when the predetermined time period $T_2$ or $t_{HOT}$ has lapsed after $Ne > Ne_1$ is established.

If $T_W \leqq T_{WHOT1}$ at the step 251, indicating that the present operation is not the hot starting of the engine, or if $V > V_1'$ at the step 252, indicating that the vehicle has started and the vehicle speed is not low, the flag $F_{HOT}$ is reset to 0 at a step 262, and the measuring value $T_{HOT}$ of the timer A is made equal to 0 at a step 263 because the supply of the intake side secondary air at the starting of the engine is not necessary. Then the program proceeds to the air/fuel ratio control routine of the step 260.

In the air/fuel ratio control routine, as shown in FIG. 9, the CPU 29 detects whether or not a condition for the feedback control of the air/fuel ratio is satisfied on the basis of each information which has been read-in, at a step 271. For example, when the engine speed is high, or when the vehicle is decelerating at a high vehicle speed, it can be regarded that the feedback condition is not satisfied. Therefore, in such a case, the output value $AF_{OUTL}'$ is made equal to 0 at a step 272, the air/fuel ratio correction value $I_{OUT}$ is made equal to 0 at a step 273, and a count value $C_{FB}'$ which will be described later is made equal to 1 at a step 274.

On the other hand, if the feedback control condition is satisfied, the base value $D_{BASE}$ of the air/fuel ratio control is searched at a step 275. In the ROM 30, values of the base value $D_{BASE}$ determined by the absolute pressure $P_{BA}$ and the engine speed Ne are previously stored as a $D_{BASE}$ data map as in the case of the previous embodiment. Therefore, the CPU 29 searches a value of the base value $D_{BASE}$ corresponding to read value of the absolute pressure $P_{BA}$ and the engine speed Ne from the $D_{BASE}$ data map. In addition, the base value $D_{BASE}$ is calculated by interpolation for values between meshes of the $D_{BASE}$ data map.

After setting the base value $D_{BASE}$, whether or not the output voltage $VO_2$ of the oxygen concentration sensor 14 is higher than the reference voltage Vref (for example, 0.5 V) is detected at a step 276. If $VO_2 > Vref$, indicating that the air/fuel ratio of the supplied mixture is richer than the stoichiometric air/fuel ratio, whether or not the flag $F_P$ is equal to 1 is detected at a step 277. If $F_P = 1$, indicating that the present operation is immediately after the air/fuel ratio has turned from lean to rich with respect to the stoichiometric air/fuel ratio, the proportional value $P_R$ ($=\alpha R \times Ne \times P_{BA}$, $\alpha R$ being a constant) is added to the air/fuel ratio correction value $I_{OUT}$, and the calculated value is determined to be a new correction value $I_{OUT}$, at a step 278. If $F_P = 0$, indicating that the air/fuel ratio is continuously rich, a value 1 is subtracted from the count value $C_{FB}'$ at a step 279, and whether or not the count value $C_{FB}'$ after the subtraction is equal to 0 is detected at a step 280. If $C_{FB}' - 0$, the integration value I ($=K \times Ne \times P_{BA}$, K being a constant) is added to the air/fuel ratio correction value $I_{OUT}$, and the calculated value is made as a new air/fuel ratio correction value $I_{OUT}$ at a step 281, and a $C_{FB}'$ setting subroutine for setting the count value $C_{FB}'$ is executed at a step 282. This $C_{FB}'$ setting subroutine will be described later.

After the execution of the step 278 or the step 282, the flag $F_P$ is reset to 0 at a step 283 so as to indicate that the air/fuel ratio was in the rich state in the present processing cycle.

On the other hand, if $VO_2 \leqq Vref$, indicating that the air/fuel ratio of the supplied mixture is leaner than the stoichiometric air/fuel ratio, whether or not the flag $F_P$ is equal to 0 is detected at a step 284. If $F_P = 0$, indicating that the operational state is immediately after that the air/fuel ratio has turned from rich to lean with respect to the stoichiometric air/fuel ratio, the proportional value $P_L$ ($=\alpha L \times Ne \times P_{BA}$, $\alpha L$ being a constant and $\alpha L \neq \alpha R$) is subtracted from the air/fuel ratio correction value $I_{OUT}$, and the calculated value is made as a new air/fuel correction value $I_{OUT}$ at a step 285. If $F_P = 1$, indicating that the air/fuel ratio has been continuously lean, a value 1 is subtracted from the count value $C_{FB}'$ at a step 286, and whether or not the count value $C_{FB}'$ after the subtraction is equal to 0 is detected at a step 287. If $C_{FB}' = 0$, the integration value I is subtracted from the air/fuel ratio correction value $I_{OUT}$, and the calculated value is made as a new air/fuel ratio correction value $I_{OUT}$, at a step 288, and executes the $C_{FB}'$ setting subroutine at a step 289. After the execution of the step 285 or the step 289, a value 1 is set to the flag $F_P$ so as to indicate that the air/fuel ratio was in the lean state in the present processing cycle, at a step 290.

After the execution of the step 283 or the step 290, the output value $AF_{OUT}'$ of the air/fuel ratio control is calculated by adding the air/fuel ratio correction value $I_{OUT}$ to the base value $D_{BASE}$ of the air/fuel ratio control at a step 291. If $C_{FB}' > 0$ in the step 280 or the step 287, the step 291 is executed immediately. The calculated output value $AF_{OUT}'$ is outputted to the drive circuit 28 at the step 257.

Therefore, the intake side secondary air having an amount corresponding to the output value $AF_{OUT}'$ is supplied to the intake manifold 4, and the air/fuel ratio of the supplied mixture is controlled toward the stoichiometric air/fuel ratio by the feedback operation.

In the case of the open loop control, the output value $AF_{OUT}'$ is set to 0 irrespectively of the output signal of the oxygen concentration sensor 14. Thus the solenoid valve 0 is closed to stop the supply of the intake side secondary air.

In the $C_{FB}'$ setting subroutine which is executed at the steps 282 and 289, whether or not the flag $F_{HOT}$ is equal to 1 is detected at a step 301, as illustrated in FIG. 10. If $F_{HOT} = 1$, indicating that the predetermined time period $t_1$ has not passed after the completion of the hot starting operation of the engine, the count value $C_{FB}'$ is set to be equal to a predetermined value $C_{FBHOT}$ at a step 302.

On the other hand, if $F_{HOT} = 0$, the present state is such that the engine is not hot, or that the predetermined time period $t_1$ has already passed after the completion of the starting operation, or after the start of the vehicle. Therefore, in this case, whether or not the operational state of the engine is the idling state is detected at a step 303. The idling state is, for example, detected as a condition in which the vacuum switch 7 is turned on, $V < 3$ Km/h, and $Ne < 1000$ rpm. If the engine is idling, the count value $C_{FB}'$ is determined in accordance with the read value of the intake air temperature $T_A$ at a step 304. If the engine is not operating in the idling state, the count value $C_{FB}'$ is set according to the read value of the engine speed Ne at a step 305. Specifically, values $C_{FBID}$ corresponding to the intake air temperature $T_A$ and values $C_{FBNE}$ corresponding to the engine speed Ne are previously determined as data in the ROM 30, and the CPU 29 reads a value of $C_{FBID}$ corresponding to the read value of the intake air temperature $T_A$, or a value of $C_{FBNE}$ corresponding to the read value of the engine speed Ne, as the count value $C_{FB}'$.

The predetermined value $C_{FBHOT}$ is determined to be smaller than the values $C_{FBID}$ and $C_{FBNE}$. Therefore, if $FHOT = 1$, that is, in the feedback control of the air/fuel ratio from the completion of the hot starting operation of the engine to the time at which the predetermined time period $t_1$ has passed, the number of times of the execution of the step 281 or the step 288 per unit time is increased. The interval of the execution of the step 281 or the step 288 is, for example, 20 milliseconds if $F_{HOT} = 1$, and, for example, more than 80 milliseconds if $F_{HOT} = 0$. Therefore, the speed of change in the air/fuel ratio correction value $I_{OUT}$ by the integral control from the completion of the hot starting operation of the engine to the time at which the predetermined time period $t_1$ has passed, that is, the speed of adjustment, becomes fast.

In the above described embodiment of the present invention, the number of execution of the step 281 and the step 288 per unit time is increased when the intake air temperature is high. However, the arrangement is not limited to this, and it is also possible to adopt an arrangement in which the speed of adjustment of the air/fuel ratio correction value is raised by enlarging the constant K in the calculation of the integral value I when $F_{HOT} = 1$.

As described above, in the air/fuel ratio control method according to the present invention, the speed of change in the air/fuel ratio correction value to be used in the feedback control of air/fuel ratio, that is, the speed of adjustment, is raised for the predetermined time period after the completion of the hot starting operation of the engine. Therefore, the air/fuel ratio is prevented from becoming over-rich which might be caused by the fuel over-flown by the percolation. Thus, is it possible to reduce the amount of unburnt components such as CO, HC, etc., exhausted from the engine immediately after the hot starting of the engine, thereby improving the efficiency of the exhaust gas purifying operation. Furthermore, it is possible to prevent the drop of the engine speed during the idling state immediately after the hot starting of the engine.

Although the embodiments of the present invention have been described as a method by which the air/fuel ratio of the mixture supplied to the engine is controlled to the stoichiometric air/fuel ratio by using a $\lambda = 1$ type oxygen concentration sensor, it should be noted that the present invention can be also applied to a case in which the air/fuel ratio of the supplied mixture is controlled to a desired air/fuel ratio other than the stoichiometric air/fuel ratio by means of an exhaust gas component concentration sensor which produces an output signal proportional to the concentration of an exhaust gas component, such as the oxygen concentration, in the exhaust gas.

What is claimed is:

1. A method of controlling the air/fuel ratio for an internal combustion engine mounted on a vehicle and provided in its exhaust system with an exhaust gas component concentration sensor which produces an output signal corresponding to the concentration of an exhaust gas component in exhaust gas of said engine, comprising steps of:

setting a base value of air/fuel ratio control in accordance with engine operational parameters, correcting the base value of air/fuel ratio control in accordance with a base correction value, comparing value of said output signal of said exhaust gas component concentration sensor with a reference value of determination of the air/fuel ratio;

adjusting an air/fuel ratio correction value in accordance with a result of said comparison;

calculating an air/fuel ratio control output value in accordance with at least one of said air/fuel ratio correction value and said corrected base value of air/fuel ratio control;

controlling an air/fuel ratio of mixture supplied to the engine in accordance with said air/fuel ratio control output value;

correcting said base correction value by a value corresponding to a renewal coefficient on basis of said air/fuel ratio correction value; and increasing magnitude of said renewal coefficient as rotational speed of said engine decreases.

2. An air/fuel ratio control method as set forth in claim 1, wherein said renewal coefficient is determined to have a largest value when said engine is idling.

3. A method of controlling the air/fuel ratio for an internal combustion engine mounted on a vehicle and provided in its exhaust system with an exhaust gas component concentration sensor which produces an output signal corresponding to the concentration of an exhaust gas component in exhaust gas of said engine, comprising steps of:

setting a base value of air/fuel ratio control in accordance with engine operational parameters, correcting the base value of air/fuel ratio control in accordance with a base correction value, comparing the value said output signal of said exhaust gas component concentration sensor with a reference value of determination of the air/fuel ratio;

adjusting an air/fuel ratio correction value in accordance with a result of said comparison;

calculating an air/fuel ratio control output value in accordance with at least one of said air/fuel ratio correction value and said corrected base value of the air/fuel ratio control;

controlling an air/fuel ratio of mixture supplied to the engine in accordance with said air/fuel ratio output value;

correcting a cumulative correction value for renewing the base correction value, by a value corresponding to a renewal coefficient on basis of the air/fuel ratio correction value;

renewing the base correction value in accordance with the cumulative correction value every time an operational state of the engine changes from one operational region to another; and increasing the maginitude of the renewal coefficient as rotational speed of said engine decreases.

4. An air/fuel ratio control method as set forth in claim 3, wherein said renewal coefficient is determined to have a maximum value when said engine is idling.

5. A method of controlling the air/fuel ratio for an internal combustion engine comprising steps of:

comparing an exhaust gas component concentration detection value detected by an exhaust gas component concentration sensor with a reference value;

adjusting an air/fuel ratio correction value in accordance with a result of said comparison;

controlling an air/fuel ratio of mixture supplied to the engine in accordance with said air/fuel ratio correction value; and increasing the speed of adjustment of the air/fuel ratio correction value for a predetermined time period after a starting operation of the engine if the temperature of the engine is higher than a predetermined temperature at said starting operation of the engine.

* * * * *